US009505576B2

(12) United States Patent
Sasaki et al.

(10) Patent No.: US 9,505,576 B2
(45) Date of Patent: Nov. 29, 2016

(54) RECORDING APPARATUS AND METHOD OF INTRODUCING RECORDING MEDIUM TO TRANSPORT PATH

(71) Applicant: SEIKO EPSON CORPORATION, Tokyo (JP)

(72) Inventors: Tsuneyuki Sasaki, Matsumoto (JP); Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/597,092

(22) Filed: Jan. 14, 2015

(65) Prior Publication Data

US 2015/0202891 A1 Jul. 23, 2015

(30) Foreign Application Priority Data

Jan. 22, 2014 (JP) ..... 2014-009702

(51) Int. Cl.

| | |
|---|---|
| ***B65H 29/24*** | (2006.01) |
| ***B41J 11/36*** | (2006.01) |
| ***B41J 11/00*** | (2006.01) |
| ***B65H 5/06*** | (2006.01) |
| ***B65H 5/22*** | (2006.01) |
| ***B65H 7/02*** | (2006.01) |

(52) U.S. Cl.

CPC ..... *B65H 29/245* (2013.01); *B41J 11/0095* (2013.01); *B41J 11/36* (2013.01); *B65H 5/06* (2013.01); *B65H 5/228* (2013.01); *B65H 7/02* (2013.01); *B65H 2511/22* (2013.01); *B65H 2511/242* (2013.01); *B65H 2511/51* (2013.01); *B65H 2515/212* (2013.01); *B65H 2553/822* (2013.01)

(58) Field of Classification Search

CPC ..... B41J 11/0095; B41J 11/04; B41J 13/03; B65H 29/245; B65H 5/228; B65H 5/06; B65H 2253/822

USPC ..... 347/104

See application file for complete search history.

(56) References Cited

U.S. PATENT DOCUMENTS 5,517,214 A * 5/1996 Bhatia ..... B41J 3/4073 101/424.1
6,367,906 B1 * 4/2002 Hiramatsu ..... B41J 29/377 347/34

(Continued)

FOREIGN PATENT DOCUMENTS

JP 08-217287 8/1996
JP 10-001239 1/1998

(Continued)

*Primary Examiner* — Julian Huffman
*Assistant Examiner* — Sharon A Polk
(74) *Attorney, Agent, or Firm* — Workman Nydegger

(57) ABSTRACT

A recording apparatus includes a setting unit which sets a recording medium; a transport unit which transports the recording medium; a detection unit which is provided in a transport path of the recording medium and detects the recording medium; and a control unit which controls the transport unit. The transport unit includes a drive roller which is provided to be capable of contacting a first surface of the recording medium and applies a sending force to the first surface, and a blowing unit which is provided in a position opposing the drive roller and is capable of blowing onto a second surface of the recording medium. When the detection unit detects the recording medium, the control unit controls the transport unit so as to cause air to be blown from the blowing unit.

10 Claims, 7 Drawing Sheets

(56) References Cited

U.S. PATENT DOCUMENTS

| | | | | |
|---|---|---|---|---|
| 8,011,779 | B2 * | 9/2011 | Matsuhashi | B41J 11/002 347/102 |
| 8,052,146 | B2 | 11/2011 | Sugiyama et al. | |
| 9,139,022 | B2 * | 9/2015 | Sasaki | B41J 11/002 |
| 2011/0109710 | A1 * | 5/2011 | Miyakoshi et al. | 347/104 |
| 2011/0292145 | A1 * | 12/2011 | Hoover et al. | 347/104 |

FOREIGN PATENT DOCUMENTS

| | | | |
|---|---|---|---|
| JP | 10001239 | A * | 1/1998 |
| JP | 2003-285959 | | 10/2003 |
| JP | 2006-232435 | | 9/2006 |
| JP | 2007-152785 | | 6/2007 |
| JP | 2008-037642 | | 2/2008 |
| JP | 2009-062163 | | 3/2009 |
| JP | 2013107330 | A * | 6/2013 |

* cited by examiner

RECORDING APPARATUS AND METHOD OF INTRODUCING RECORDING MEDIUM TO TRANSPORT PATH

BACKGROUND

1. Technical Field

The present invention relates to a recording apparatus and a method of introducing a recording medium to a transport path.

2. Related Art

In the related art, a recording apparatus which transports a recording medium using a transport unit with a drive roller is used. For example, JP-A-2007-152785 discloses a recording apparatus which transports a recording medium using a transport unit that is provided on the transport path of the recording medium, includes a drive roller, and is configured by a pair of rollers which pinch the recording medium.

However, in a recording apparatus of the related art such as that described above, there is a case in which, when introducing the recording medium to the transport path, after the recording medium is introduced to the transport path of the recording medium, the weight of the recording medium itself causes the recording medium to escape from the transport path.

In this manner, the recording apparatus of the related art has poor usability when introducing the recording medium to the transport path.

SUMMARY

An advantage of some aspects of the invention is to improve the usability when introducing the recording medium to the transport path.

According to an aspect of the invention, a recording apparatus includes a setting unit which sets a recording medium; a transport unit which transports the recording medium; a detection unit which is provided in a transport path of the recording medium and detects the recording medium; and a control unit which controls the transport unit, in which the transport unit includes a drive roller which is provided to be capable of contacting a first surface of the recording medium and applies a sending force to the first surface, and a blowing unit which is provided in a position opposing the drive roller and is capable of blowing onto a second surface of the recording medium, and in which, when the detection unit detects the recording medium, the control unit controls the transport unit so as to cause air to be blown from the blowing unit.

In this case, when the detection unit detects the recording medium, the control unit controls the transport unit so as to cause air to be blown from the blowing unit. When the recording medium is introduced to the position at which the drive roller and the blowing unit oppose each other, on air being blown from the blowing unit, the recording medium is held by being pushed onto the drive roller by the air from the blowing unit. Therefore, it is possible to suppress the occurrence of the weight of the recording medium itself causing the recording medium to escape from the transport path after introducing the recording medium to the transport path of the recording medium. In this manner, it is possible to improve the usability when introducing the recording medium to the transport path.

According to another aspect of the invention, a recording apparatus includes a setting unit which sets a recording medium; a transport unit which transports the recording medium; a detection unit which is provided on the setting unit and detects the recording medium; and a control unit which controls the transport unit, in which the transport unit includes a drive roller which is provided to be capable of contacting a first surface of the recording medium and applies a sending force to the first surface, and a blowing unit which is provided in a position opposing the drive roller and is capable of blowing onto a second surface of the recording medium, and in which, when the detection unit detects the recording medium, the control unit controls the transport unit so as to cause air to be blown from the blowing unit.

Here, the term "setting unit" refers to a component which sets the recording medium in order to send the recording medium to the region at which the recording is executed. For example, a setting unit which sets a roll-shaped recording medium, and a setting unit referred to as a paper supply (feed) tray and a paper supply (feed) cassette or the like, which sets single-sheet recording media correspond to the setting unit.

In this case, when the detection unit detects the recording medium, that is, when the detection unit detects that the recording medium is set on the setting unit, the control unit controls the transport unit so as to cause air to be blown from the blowing unit. When the recording medium is introduced to the position at which the drive roller and the blowing unit oppose each other, on air being blown from the blowing unit, the recording medium is held by being pushed onto the drive roller by the air from the blowing unit. Therefore, it is possible to suppress the occurrence of the weight of the recording medium itself causing the recording medium to escape from the transport path after introducing the recording medium to the transport path of the recording medium. In this manner, it is possible to improve the usability when introducing the recording medium to the transport path.

In the recording apparatus, the detection unit may be provided on a downstream side of the transport unit in a transport direction of the recording medium.

In this case, the detection unit is provided on the downstream side of the transport unit in the transport direction of the recording medium. Therefore, the detection unit is capable of detecting at high precision that the recording medium is introduced to the position at which the drive roller and the blowing unit oppose each other. Therefore, it is possible to suppress the waste that accompanies blowing air from the blowing unit before the recording medium is introduced to the position at which the drive roller and the blowing unit oppose each other.

In the recording apparatus, the blowing unit may be capable of adjusting an air blowing amount according to control of the control unit.

In this case, the blowing unit is capable of adjusting the air blowing amount according to the control of the control unit. In other words, it is possible to adjust the pinching force applied to the recording medium by the drive roller and the air that is blown by the blowing unit in the transport unit. Therefore, the transport unit is capable of precisely transporting the recording medium P and suppressing transport problems by adjusting the air blowing amount according to the recording medium or the like to be used, for example.

The recording apparatus may further include a transport amount detection unit capable of detecting a transport amount of the recording medium, in which the control unit may be capable of adjusting the air blowing amount of the blowing unit according to the transport amount detected by the transport amount detection unit.

In this case, the control unit is capable of adjusting the air blowing amount of the blowing unit according to the transport amount that is detected by the transport amount detection unit. Therefore, for example, when the transport amount that is detected by the transport amount detection unit differs from a predetermined amount, it is possible to adjust the transport amount by adjusting the air blowing amount to adjust the pinching force in the transport unit that accompanies the transportation of the recording medium and the tension or the like in the transport direction of the recording medium.

In the recording apparatus the blowing unit may be capable of adjusting the air blowing amount in a direction intersecting a transport direction of the recording medium according to the control of the control unit.

In this case, the blowing unit is capable of adjusting the air blowing amount in the direction intersecting the transport direction of the recording medium according to the control of the control unit. Therefore, it is possible to transport the recording medium as appropriate by adjusting the air blowing amount in the direction that intersects the transport direction of the recording medium.

The recording apparatus may further include a width detection unit capable of detecting a width of the recording medium in the direction intersecting the transport direction of the recording medium, in which the control unit may be capable of adjusting the air blowing amount of the blowing unit in the direction intersecting the transport direction of the recording medium according to the width detected by the width detection unit.

In this case, the control unit is capable of adjusting the air blowing amount of the blowing unit in the direction intersecting the transport direction of the recording medium according to the width detected by the width detection unit. Therefore, since it is possible to adjust the air blowing amount according to the width of the recording medium to be used, for example, when the narrow-width recording medium is used, it is possible to suppress waste such as blowing air in positions that do not oppose the recording medium.

The recording apparatus may further include a skewed transport detection unit capable of detecting a skew direction when the recording medium is subjected to skewed transport, in which the control unit may be capable of adjusting the air blowing amount of the blowing unit in the direction intersecting the transport direction of the recording medium according to the skew direction detected by the skewed transport detection unit.

In this case, the control unit is capable of adjusting the air blowing amount of the blowing unit in the direction intersecting the transport direction of the recording medium according to the skew direction which is detected by the skewed transport detection unit. Therefore, when the tension of the recording medium in the transport direction is different in the direction that intersects the transport direction due to the recording medium being skewed, the control unit is capable of reducing or correcting the skewing of the recording medium by adjusting the air blowing amount of the blowing unit in the direction that intersects the transport direction to reduce the difference in the tension.

In the recording apparatus, the blowing unit may be a fan that is capable of blowing out ions.

In this case, the blowing unit is a fan that is capable of blowing out ions. Therefore, it is possible to improve the recording quality by removing static electricity from the recording medium using the ions before recording.

The recording apparatus may further include a recording unit which performs recording onto the recording medium, in which the control unit may be capable of adjusting the air blowing amount of the blowing unit according to whether a recording operation to the recording medium by the recording unit is underway or not.

In this case, the control unit is capable of adjusting the air blowing amount of the blowing unit according to whether a recording operation to the recording medium by the recording unit is underway or not. Therefore, for example, it is possible to lessen the air blowing amount of the blowing unit to an extent that the recording medium does not move at times other than during the recording operation. In this manner, it is possible to suppress the occurrence of damaging the recording medium by continually pinching the recording medium with a strong pinching force in the transport unit.

According to still another aspect of the invention, a method of introducing a recording medium to a transport path includes setting the recording medium in a recording apparatus; detecting the recording medium; and blowing, when the recording medium is detected in the detecting, air toward a drive roller, which is provided to be capable of contacting a first surface of the recording medium and applies a sending force to the first surface, from a blowing unit which is provided in a position opposing the drive roller and is capable of blowing onto a second surface of the recording medium.

In this case, in the blowing, when the recording medium is detected in the detecting, air is blown toward the drive roller. When the recording medium is introduced to the position at which the drive roller and the blowing unit oppose each other, on air being blown from the blowing unit, the recording medium is held by being pushed onto the drive roller by the air from the blowing unit. Therefore, it is possible to suppress the occurrence of the weight of the recording medium itself causing the recording medium to escape from the transport path after introducing the recording medium to the transport path of the recording medium. In this manner, it is possible to improve the usability when introducing the recording medium to the transport path.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed description will be given below of recording apparatuses according to the examples of the invention with reference to the attached drawings.

Example 1 (FIGS. 1 to 5)

Figure 1:
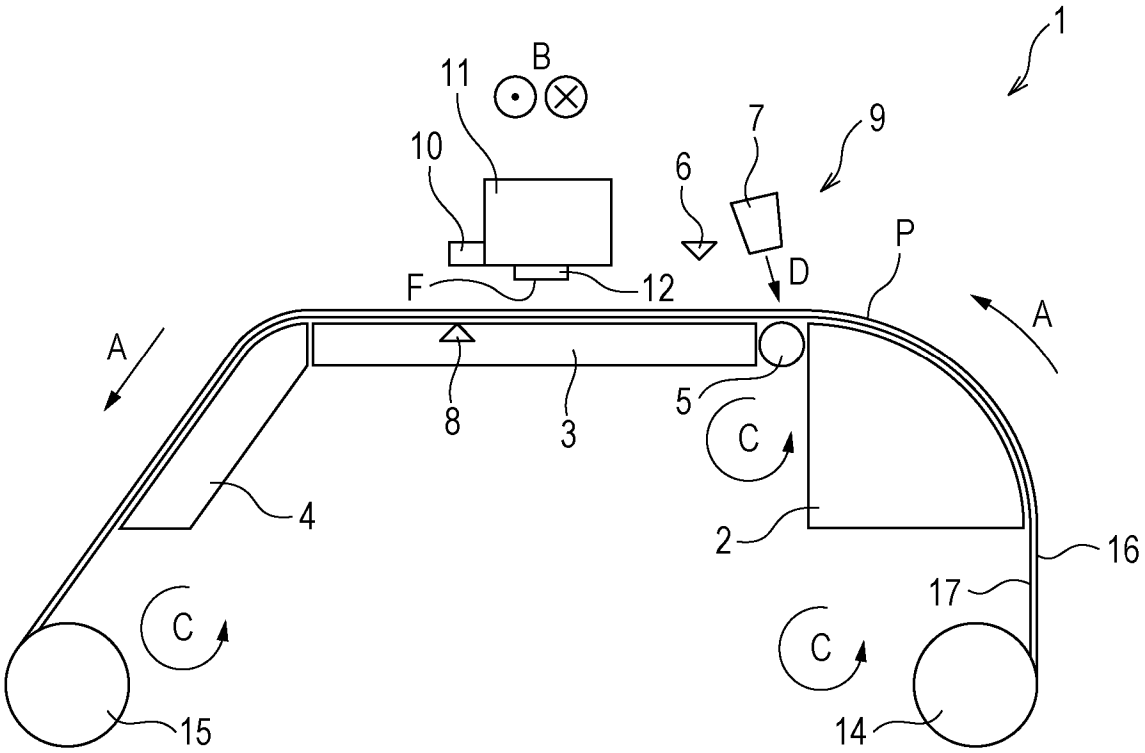
FIG. 1 is a schematic side diagram illustrating a recording apparatus according to example 1 of the invention.

FIG. 1 is a schematic side diagram illustrating a recording apparatus 1 according to example 1 of the invention.

The recording apparatus 1 of the present example transports a recording medium P from a setting unit 14 of the recording medium P, to a winding unit 15 of the recording medium P via a platen 2, a platen 3, and a platen 4, which are supporting portions of the recording medium P, in a transport direction A. In other words, from the setting unit 14 to the winding unit 15 is the transport path of the recording medium P in the recording apparatus 1, and the platen 2, the platen 3, and the platen 4 are the supporting portions of the recording medium P provided in the transport path. Note that, the setting unit 14 supplies the recording medium P by rotating in a rotation direction C, and the winding unit 15 winds the recording medium P by rotating in the rotation direction C.

Note that, the recording apparatus 1 of the present example is configured to be capable of performing recording on the roll-shaped recording medium P; however, the recording apparatus 1 is not limited to such a configuration, and may be configured to be capable of performing recording on a single-sheet recording medium P. When the recording apparatus 1 is configured to be capable of performing recording on the single-sheet recording medium P, a setting unit referred to as a so-called paper supply (feed) tray, and a paper supply (feed) cassette or the like, for example, may be used as the setting unit 14 of the recording medium P. As a collecting portion of the recording medium P, a collecting portion referred to as a so-called discharge reception portion, an output (discharge) tray, and an output (discharge) cassette or the like, for example, may be used as a collecting portion other than the winding unit 15.

In the recording apparatus 1 of the present example, a drive roller 5 is provided between the platen 2 and the platen 3, and a fan 7, which is a blower, is provided in a position (above) opposing the drive roller 5. The fan 7 is capable of blowing air in a direction D toward the drive roller 5. It is possible to push the recording medium P onto the drive roller 5 using the air pressure. According to this configuration, the transport unit 9 is configured by the drive roller 5 and the fan 7.

Expressed in different terms, the transport unit 9 includes the drive roller 5, and the fan 7. The drive roller 5 is provided to be capable of contacting a first surface 17 (the rear surface in relation to the recording surface) of the recording medium P and applies a sending force to the first surface 17. The fan 7 is provided in a position opposing the drive roller 5 and is capable of blowing air onto a second surface 16 (the recording surface) of the recording medium P.

In this manner, the transport unit 9 of the present example is capable of transporting the recording medium P without contacting and pinching the recording surface side of the recording medium P between a driven roller and a drive roller. Therefore, problems in transportation, such as roller marks being left on the recording medium P when the recording medium P is transported, are suppressed. In particular, the configuration makes it possible to prevent the driven roller from leaving a mark on the recording surface side of the recording medium P.

Note that, in the present example, since the roll recording medium P, which is wound such that the recording surface thereof is on the outside, is used, when supplying the recording medium P from the setting unit 14, the setting unit 14 rotates in the rotation direction C. Meanwhile, when the roll recording medium P, which is wound such that the recording surface thereof is on the outside, is used, the setting unit 14 is capable of supplying the recording medium P by rotating a rotating shaft in the opposite direction to the rotation direction C.

In a similar manner, since the winding unit 15 of the present example winds the recording medium P such that the recording surface thereof is on the outside, the winding unit 15 rotates the rotating shaft in the rotation direction C. Meanwhile, when the winding unit 15 winds the recording medium P such that the recording surface thereof is on the inside, the winding unit 15 can wind the recording medium P by rotating the rotating shaft in the opposite direction from the rotation direction C.

In the transport path of the recording medium P, an optical sensor 6 is provided on the downstream side of the transport unit 9 in the transport direction A as the detection unit that detects the recording medium P. The sensor 6 detects that the recording medium P is introduced to a position at which the drive roller 5 and the fan 7 oppose each other.

In the recording apparatus 1 of the present example, a recording head 12 is provided on the side opposing the platen 3 as a recording unit. The recording apparatus 1 forms a desired image by discharging an ink from an ink discharge surface F of the recording head 12 onto the recording medium P while reciprocally moving the recording head 12 in a direction B which intersects the transport direction A via a carriage 11.

Note that, the recording apparatus 1 of the present example is provided with the recording head 12, which performs recording while moving reciprocally; however, the recording apparatus 1 may also be a recording apparatus provided with a so-called line head, in which a plurality of nozzles that discharge an ink is provided in a direction intersecting the transport direction A.

Here, the term "line head" refers to a recording head which is provided such that a nozzle region, which is formed in an intersecting direction that intersects the transport direction A of the recording medium P, can cover the entire intersecting direction of the recording medium P and is used in a recording apparatus which fixes one of the recording head or the recording medium, causes the other to move, and forms an image. Note that, the nozzle region provided in the intersecting direction of the line head may not be configured to be capable of covering the entire intersecting direction of the entire recording medium P that the recording apparatus supports.

A sensor 10 is provided on the carriage 11. The sensor 10 performs the role of a width detection unit, which is capable of detecting the width of the recording medium P in the direction B that opposes the transport direction A, and the role of a skewed transport detection unit, which is capable of detecting the skew direction when the recording medium P is subjected to skewed transport. Detailed description of the sensor 10 will be given later.

A sensor 8 is provided on the platen 3 as a transport amount detection unit which is capable of detecting the transport amount of the recording medium. Note that, in the recording apparatus 1 of the present example, the platen 3 is provided with the sensor 8; however, the sensor 8 may be provided in another location.

Note that, in the recording apparatus 1 of the preset example, the transport unit 9 is provided on the upstream side of the recording head 12 in the transport direction A. However, the transport unit 9 may be provided on both sides in the transport direction A to interpose the recording head 12. In the configuration in which the transport unit 9 is provided on both sides, since it is possible to push the recording medium P onto the drive roller 5 on both sides, it is possible to effectively suppress transportation problems such as jamming.

Here, the fan 7 of the transport unit 9 is a fan that blows out ions. Expressed in different terms, the recording apparatus 1 of the present example is provided with a fan which is capable of blowing out ions to the upstream side of the transport direction of the recording medium P in relation to the recording head 12. Therefore, it is possible to improve the recording quality by removing static electricity from the recording medium P using the ions before recording with the recording head 12. It is possible to achieve cost reductions by causing the transport unit 9 to also perform the role of a static electricity removal unit of the recording medium P. Note that, an ionizer in which an ion generator and a fan are integrated, is exemplified as a specific example of the fan that blows out ions, which is also used in the present example. However, the fan that blows out ions is not limited to the ionizer. A configuration including a fan other than the fan that blows out ions is included in the invention.

Figure 2:
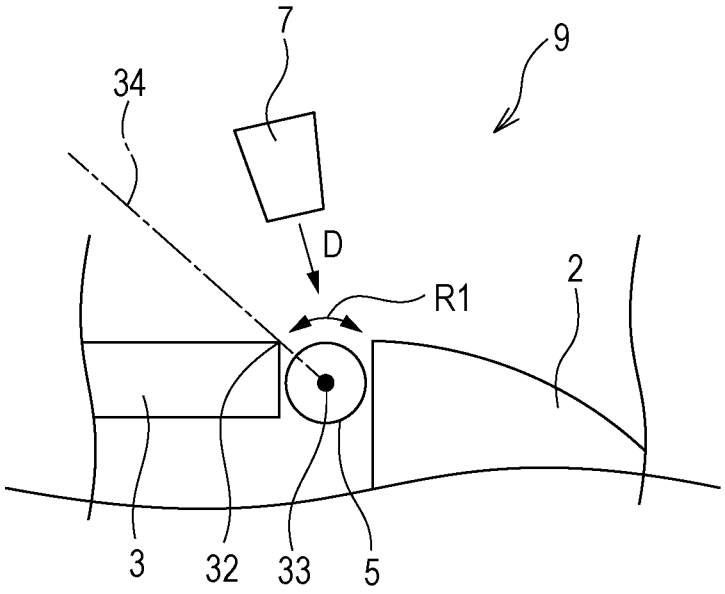
FIG. 2 is an enlarged diagram of the main parts of the recording apparatus according to example 1 of the invention.

As illustrated in FIG. 1, and in FIG. 2 which is an enlarged diagram of the main parts of the recording apparatus 1 of the present example, the fan 7 of the transport unit 9 blows in the direction D, which is the direction going away from the recording head 12. Specifically, the fan 7 blows air in the direction D toward the upstream side of the transport direction A. Therefore, the occurrence of the air sent from the fan 7 influencing the flying state of the ink that is discharged from the recording head 12 and causing shifting of the landing position onto the recording medium P is suppressed. Foreign matter adhered to the second surface 16 of the recording medium P is removed by the blowing, and it is possible to suppress the occurrence of recording problems.

Note that, in the present example, the fan 7 blows such that air flows in a direction opposite to the direction in which the recording head is situated; however, the fan 7 may be configured to blow such that air flows in a direction that intersect the direction in which the recording head is situated. In this case, the occurrence of a mist of the ink that floats between the recording head 12 and the recording medium P and is discharged from the recording head 12 adhering to the recording head 12 again is suppressed, and it is possible to discharge the ink from the recording head 12 in a stable manner. However, a configuration in which the blowing direction of the fan 7 is a direction toward the recording head 12 is included in the invention. Fans 7*a*, 7*b*, 7*c*, and 7*d* may be configured to be capable of individually changing the air direction according to the position of the carriage 11 which moves in the direction B in the downstream side of the transport direction. For example, a configuration may be adopted in which the fan which is positioned at the downstream side in the movement direction of the carriage 11 in the direction B blows air toward the downstream side such that the air flows in a direction opposite to the direction toward the recording head 12, and the fan which is positioned at the downstream side in the movement direction of the carriage 11 in the direction B blows air toward the downstream side.

Next, description will be given of an electrical configuration in the recording apparatus 1 of the present example.

Figure 3:
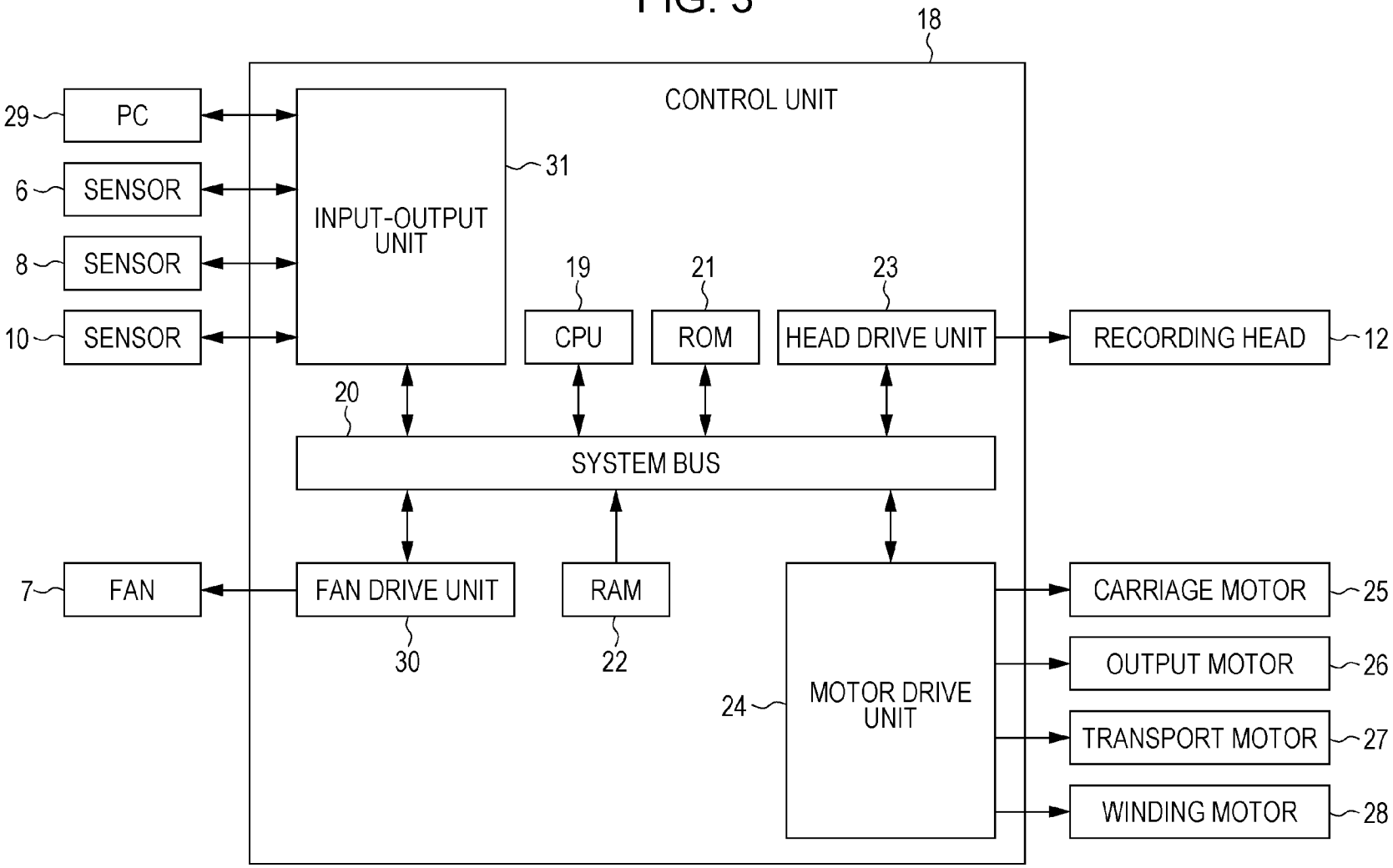
FIG. 3 is a block diagram of the recording apparatus according to example 1 of the invention.

FIG. 3 is a block diagram of the recording apparatus 1 of the present example.

A control unit 18 is provided with a CPU 19 which manages the control of the entire recording apparatus 1. The CPU 19 is connected to a ROM 21 and RAM 22 via a system bus 20. The ROM 21 stores the various control programs and maintenance sequences that are executed by the CPU 19, and the RAM 22 is capable of temporarily storing data.

The CPU 19 is connected to a head drive unit 23, which is for driving the recording head 12, via the system bus 20.

The CPU 19 is connected to a carriage motor 25, a supply motor 26, a transport motor 27, a winding motor 28, and a motor drive unit 24 via the system bus 20. The carriage motor 25 is for moving the carriage 11, the supply motor 26 is the drive source of the setting unit 14, the transport motor 27 is the driving source of the drive roller 5, the winding motor 28 is the drive source of the winding unit 15, and the motor drive unit 24 is for driving the motors described above.

The CPU 19 is connected to a fan drive unit 30, which is for driving the fan 7, via the system bus 20.

Furthermore, the CPU 19 is connected to an input-output unit 31 via the system bus 20, the input-output unit 31 is connected to the sensors 6, 8, and 10, and to the PC 29 which is an external apparatus that inputs recording data and the like to the recording apparatus 1.

The recording apparatus 1 of the present example includes the setting unit 14, the transport unit 9, and the sensor 6. The setting unit 14 sets the recording medium P, the transport unit 9 transports the recording medium P, and the sensor 6 is provided in the transport path of the recording medium P and detects the recording medium P.

The control unit 12 is capable of controlling the transport unit 9, and when the sensor 6 detects the recording medium P, the control unit 12 controls the transport unit 9 so as to cause air to be blown from the fan 7.

When the recording medium P is introduced to the position at which the drive roller 5 and the fan 7 oppose each other, on air being blown from the fan 7, the recording medium P is held by being pushed onto the drive roller 5 by the air from the fan 7. Therefore, the recording apparatus 1 of the present example suppresses the occurrence of the weight of the recording medium P itself causing the recording medium to escape from the transport path after introducing the recording medium P to the transport path of the recording medium P. In this manner, the usability when introducing the recording medium P to the transport path is improved.

As illustrated in FIG. 1, the sensor 6 of the recording apparatus 1 of the present example is provided on the downstream side of the transport unit 9 in the transport direction A.

Therefore, the sensor 6 detects at precision that the recording medium P is introduced to the position at which the drive roller 5 and the fan 7 oppose each other. Therefore, waste that accompanies blowing air from the blowing unit before the recording medium P is introduced to the position at which the drive roller 5 and the fan 7 oppose each other is suppressed.

The fan 7 of the recording apparatus 1 of the present example is capable of adjusting the air blowing amount according to the control of the control unit 18. Specifically, as described later, it is possible to adjust the air blowing amount in the direction B, and it is possible to adjust the air blowing amount of all the air that is blown from the fan 7. Therefore, it is possible to adjust the pinching force applied to the recording medium P by the drive roller 5 and the air that is blown by the fan 7 in the transport unit 9.

Therefore, the transport unit 9 is capable of precisely transporting the recording medium P by adjusting the air blowing amount according to the recording medium P that is used or the like, for example, and the recording apparatus 1 of the present example is configured to be capable of suppressing transport problems.

As illustrated in FIG. 2, it is desirable to adjust the transport amount so as to pinch the recording medium P in a range R1 that does not exceed a straight line 34 joining the rotating shaft 33 of the drive roller 5 and an outer edge portion 32, which is the end portion of the downstream side in the transport direction A in the platen 3. By adopting this configuration, it is possible to transport the recording medium P in a stable manner.

As described above, the recording apparatus 1 of the present example is provided with a sensor 8 that is capable of detecting the transport amount of the recording medium P.

The control unit 18 is capable of adjusting the air blowing amount of the fan 7 according to the transport amount that is detected by the sensor 8.

Therefore, for example, when the transport amount that is detected by the sensor 8 differs from a predetermined amount, the transport amount is adjusted by adjusting the air blowing amount to adjust the pinching force in the transport unit 9 that accompanies the transportation of the recording medium P and the tension or the like in the transport direction A of the recording medium P.

As described above, the recording apparatus 1 of the present example is provided with the recording head 12 as the recording unit which records onto the recording medium P.

The control unit 18 is capable of adjusting the air blowing amount of the fan 7 according to whether the recording operation of to the recording medium P by the recording head 12 is underway or not.

Therefore, for example, it is possible to lessen the air blowing amount of the fan 7 to an extent that the recording medium P does not move at times other than during the recording operation. When the carriage 11 is not present in the region on above the platen 3, the blowing of the fan 7 may be stopped. In this manner, the configuration is capable of suppressing the occurrence of damaging the recording medium P by continually pinching the recording medium P with a strong pinching force in the transport unit 9.

Next, description will be given of the specific configurations and functions of the fan 7, the sensor 8, and the sensor 10.

Figure 4:
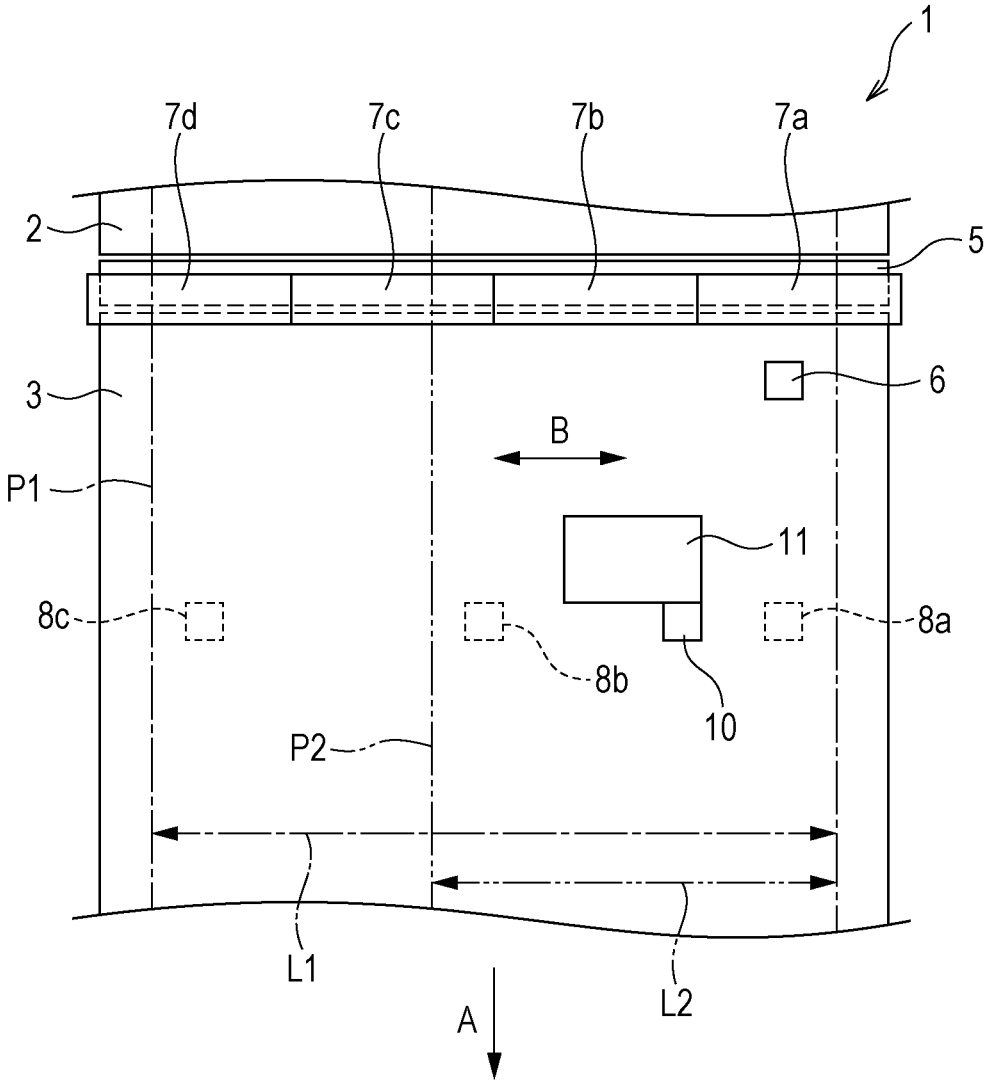
FIG. 4 is a schematic plan diagram illustrating the recording apparatus according to example 1 of the invention.
Figure 5:
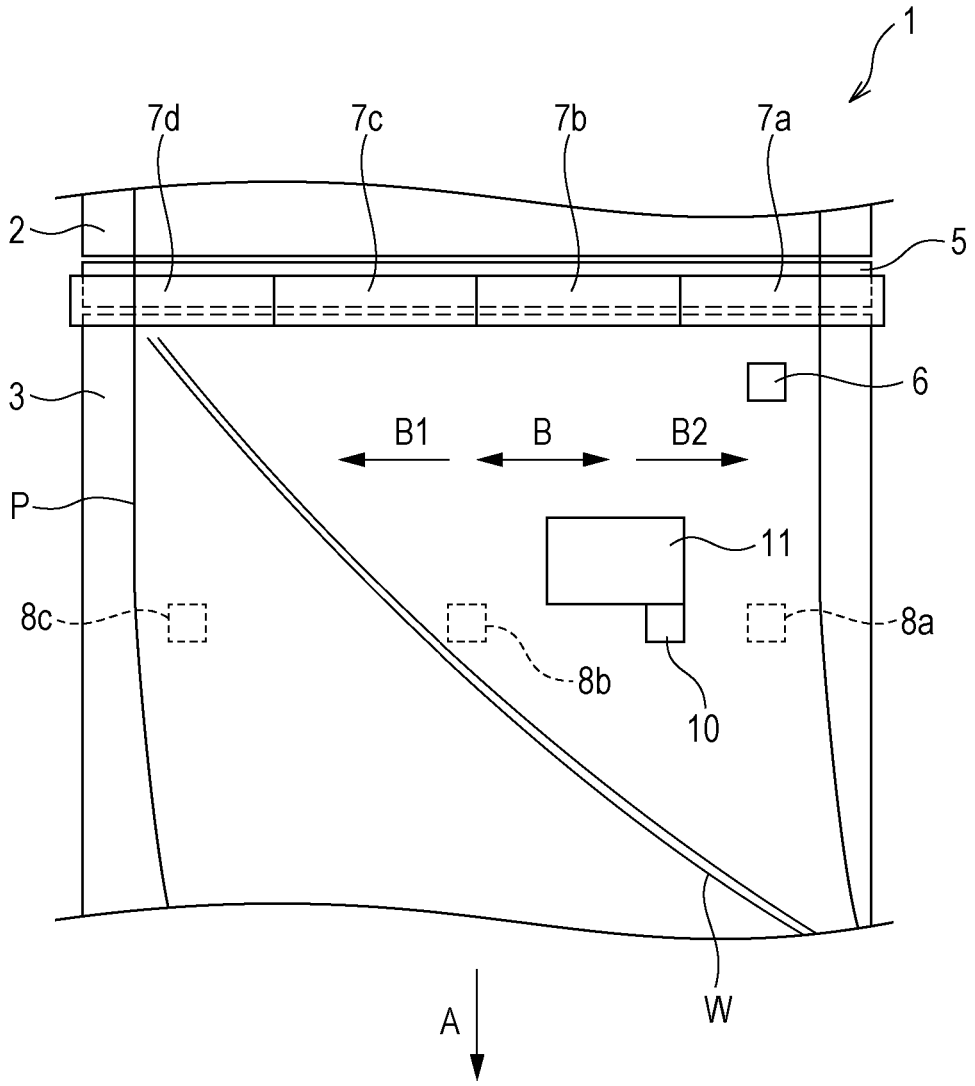
FIG. 5 is a schematic plan diagram illustrating the recording apparatus according to example 1 of the invention.

FIGS. 4 and 5 are schematic plan views illustrating the recording apparatus 1 of the present example. Specifically, FIG. 4 illustrates the supporting position of the usable recording medium P in the platen 3 of the recording apparatus 1. FIG. 5 schematically illustrates a case in which the recording medium P is subjected to skewed transport.

The fan 7 of the recording apparatus 1 of the present example is configured to be divided into the four fans 7*a*, 7*b*, 7*c*, and 7*d*, and the control unit 18 is configured to be capable of controlling the air blowing amount in the direction B by individually controlling the fans 7*a*, 7*b*, 7*c*, and 7*d*.

In other words, the fan 7 is capable of adjusting the air blowing amount in the direction B that intersects the transport direction A according to the control of the control unit 18. Therefore, the configuration is capable of appropriately transporting the recording medium P by adjusting the air blowing amount in the direction B.

Note that, the fan 7 of the present example is configured to be divided into four parts in the direction B; however, the fan 7 may be divided into three or less, or five or more parts. It is possible to raise the air speed to a desired level by narrowing a blow-out port of the fan 7. The fan 7 may be provided with an internal heater such that warm air is blown, and the drying of the ink is further promoted when forming a desired image by causing the ink to be discharged onto the recording medium P from an ink discharge surface F of the recording head 12 due to the recording medium P being heated by the heater.

The recording apparatus 1 of the represent example is provided with sensors 8*a*, 8*b*, and 8*c* as the sensor 8 in the direction Bin order from the home position side that is equivalent to the right side in FIGS. 4 and 5.

The sensor 6 is provided on the home position side in the direction B and is positioned to oppose the platen 3.

Note that, the disposition and the number of the sensor 8 and the sensor 6 are not limited to those of the present example.

As illustrated in FIG. 4, the recording apparatus 1 of the present example is capable of using a recording medium P1 of a width L1 in the direction B, and a recording medium P2 of a width L2 in the direction B as the recording medium P. Note that, the width of the recording medium P can be detected by the sensor 10 detecting the recording medium P while the carriage 11 moves in the direction B. In other words, the recording apparatus 1 of the present example is provided with the sensor 10 as a width detection unit that is capable of detecting the width of the recording medium P in the direction B.

The control unit 18 is capable of adjusting the air blowing amount of the fan 7 in the direction B according to the width of the recording medium P which is detected by the sensor 10.

Therefore, it is possible to adjust the air blowing amount of the fan 7 according to the width of the recording medium P that is used. For example, when the narrow-width recording medium P2 is used, the control unit 18 performs control such that the fan 7*d* in the position not opposing the recording medium P2 does not blow air, and it is possible to suppress waste such as blowing air in positions that do not oppose the recording medium P2.

Note that, the recording apparatus 1 of the present example is configured to be capable of using the recording medium P1 of the width L1 and the recording medium P2 of the width P2; however, the recording apparatus 1 may be configured to be capable of using the recording medium P of three or more types with differing widths.

As described above, the sensor 10 is configured to be capable of detecting the skew direction when the recording medium P is subjected to skewed transport. Specifically, the sensor 10 of the present example is configured to be capable of measuring a distance (PG) between the recording medium P and the sensor 10 at a plurality of positions in the transport direction A. Here, for example, as illustrated in FIG. 5, when the recording medium P is skewed in the direction of the home position side (the right side in the drawing) in the direction B as the recording medium P is transported to the downstream side in the transport direction A, a wrinkle W running toward the right side in the drawing occurs as the recording medium P proceeds to the downstream side in the transport direction A. When the wrinkle W occurs in this manner, the sensor 10 detects a PG abnormality closer to the right side in the drawing at the detection position of the downstream side than at the detection position of the upstream side in the transport direction A. According to this configuration, the sensor 10 is configured to be capable of detecting the skew direction when the recording medium P is subjected to skewed transport.

However, the configuration of the sensor 10 is not limited to this configuration.

As described above, the recording apparatus 1 of the present example is provided with the sensor 10 which is capable of detecting the skew direction when the recording medium P is subjected to skewed transport.

The control unit 18 is capable of adjusting the air blowing amount of the fan 7 in the direction which intersects the transport direction of recording medium P according to the skew direction which is detected by the sensor 10.

Therefore, when the tension of the recording medium P in the transport direction A is different in the direction B due to the recording medium P being skewed, the control unit 18 is configured to be capable of reducing or correcting the skewing of the recording medium P by adjusting the air blowing amount of the fan 7 in the direction B to reduce the difference in the tension in the direction B. For example, when the recording medium P is transported intermittently, a desired image is formed by discharging an ink from the ink discharge surface F of the recording head 12 onto the recording medium P while reciprocally moving the recording head 12 in the direction B which intersects the transport direction A via the carriage 11. In this case, the air blowing amounts of the fans 7*a*, 7*b*, 7*c*, and 7*d* in the direction B are fixed, and during the transportation of the recording medium P after the image formation, the air blowing amounts of the fans 7*a* and 7*b* are reduced to less than those of the fans 7*c* and 7*d*; or, the air blowing amounts of the fans 7*c* and 7*d* are increased to more than those of the fans 7*a* and 7*b*. It is possible to suppress the occurrence of a problem in which, when forming the image, the recording medium P lifts up from the platen 3 due to changes in the air blowing amounts of the fans 7*a*, 7*b*, 7*c*, and 7*d*, and makes contact with the carriage 11.

Note that, since the recording apparatus 1 of the present example includes the plurality of sensors 8 as the transport amount detection unit that is capable of detecting the transport amount of the recording medium P, the sensors 8*a*, 8*b*, and 8*c* in the direction B, it is possible to detect the skew direction from the differences in the transport amounts of the recording medium P that are detected by the sensors 8*a*, 8*b*, and 8*c*. The control unit 18 is capable of adjusting the air blowing amount of the fan 7 in the direction which intersects the transport direction of the recording medium P according to the skew direction that is detected by the sensor 8.

Figure 6:
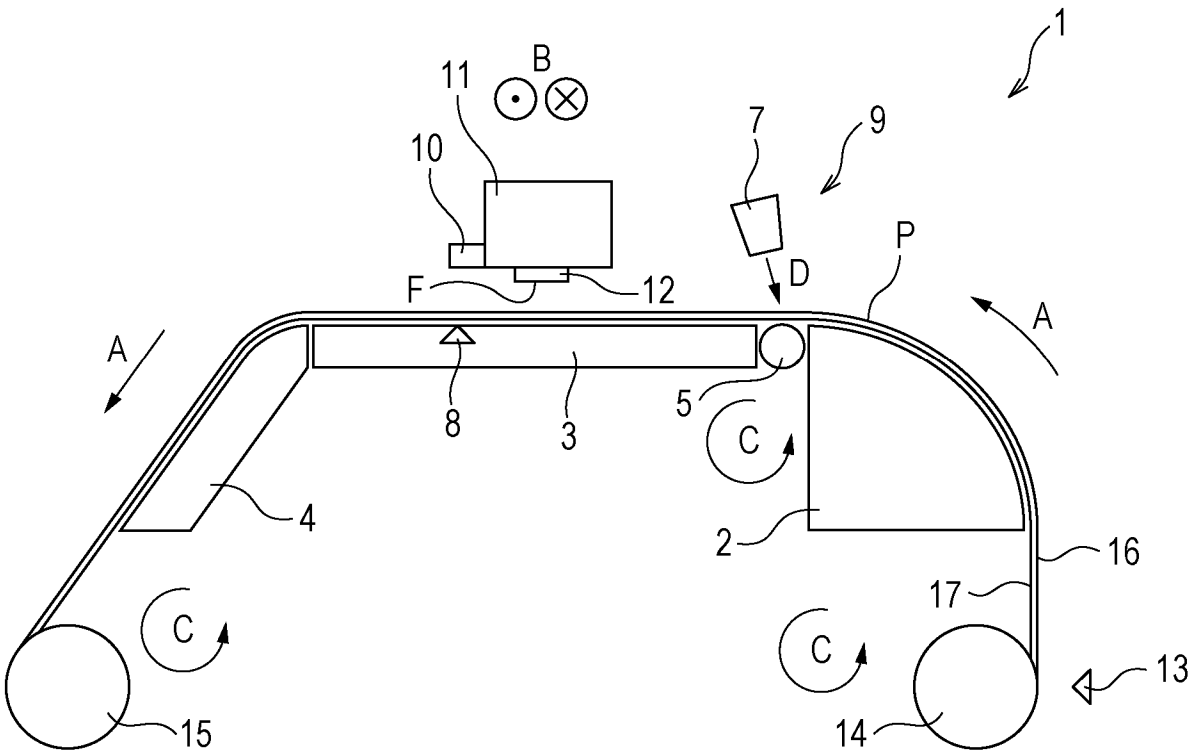
FIG. 6 is a schematic side diagram illustrating a recording apparatus according to example 2 of the invention.

Example 2 (FIG. 6)

Next, detailed description will be given of a recording apparatus of the second example with reference to the attached drawings.

FIG. 6 illustrates a schematic side diagram of the recording apparatus 1 of the present example. Note that, components which are common with those of the example described above are represented with the same reference numerals, and detailed description thereof is omitted.

Note that, the configuration of the recording apparatus 1 of the present example differs from that of the recording apparatus 1 of example 1 only in that, instead of the optical sensor 6 being provided on the downstream side of the transport unit 9 as the detection unit which detects the recording medium P, an optical sensor 13 is provided at the setting unit 14 as the detection unit which detects the recording medium P.

The recording apparatus 1 of the present example is provided with the setting unit 14 and the transport unit 9 of the same configurations as those of the recording apparatus 1 of example 1.

As described above, the sensor 13 which detects the recording medium P is provided at the setting unit 14.

When the sensor 13 detects the recording medium P, the control unit 18 controls the transport unit 9 so as to cause air to be blown from the fan 7.

In this manner, when the sensor 13 detects the recording medium P, that is, when the sensor 13 detects that the recording medium P is set on the setting unit 14, the control unit 18 of the present example controls the transport unit 9 so as to cause air to be blown from the fan 7. Therefore, the recording apparatus 1 of example 1 suppresses the occurrence of the weight of the recording medium P itself causing the recording medium to escape from the transport path after introducing the recording medium P to the transport path of the recording medium P. In this manner, the usability when introducing the recording medium P to the transport path is improved.

Note that, when the time from the recording medium P being set on the setting unit 14 to the recording medium P being introduced to the transport path of the recording medium P exceeds a predetermined time, the control unit 18 may be configured to perform control such that the blowing from the fan 7 is stopped.

Figure 7:
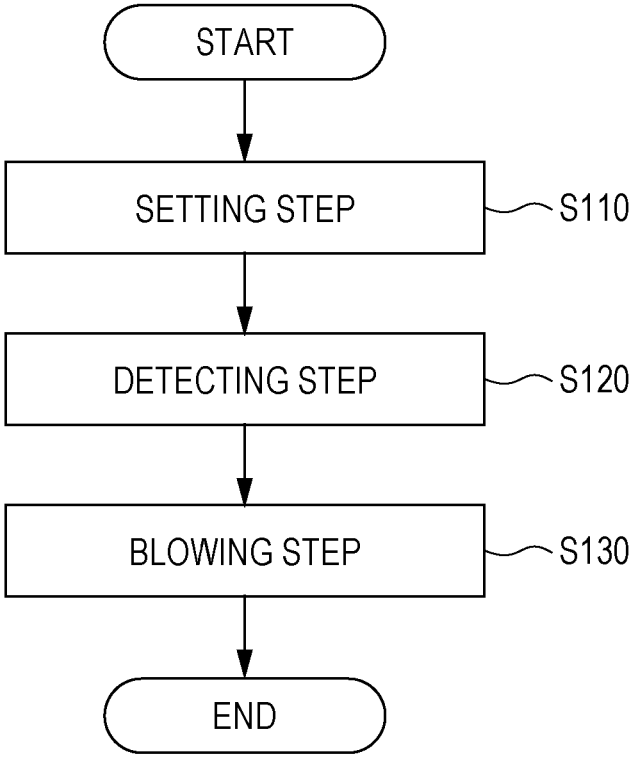
FIG. 7 is a flowchart of a method of introducing a recording medium to a transport path according to an example of the invention.

Example of Method of Introducing Recording Medium to Transport Path (FIG. 7)

Next, description will be given of an example of the method of introducing the recording medium to the transport path using the recording apparatus 1 of example 1.

FIG. 7 is a flowchart of the method of introducing the recording medium to the transport path of the present example.

In the method of introducing the recording medium to the transport path of the present example, first, in a setting step of step S110, the recording medium P is set on the setting unit 14 of the recording apparatus 1 by the user.

When the recording medium P is set by the user, in a detecting step of step S120, the recording medium P is detected. Note that, the present step is a step in which, in the present example, since the recording apparatus 1 of example 1 is used, the user introduces the recording medium P to the transport path and the recording medium P that is introduced to the transport path is detected by the sensor 6. However, for example, a step may be adopted in which the sensor 13 detects that the recording medium P is set on the setting unit 14 using the recording apparatus 1 of example 2.

When the recording medium P is detected in step S120, air is blown from the fan 7, which is provided in a position opposing the drive roller 5 and is capable of blowing air onto the second surface 16 of the recording medium P, toward the drive roller 5 which is provided to be capable of contacting the first surface 17 of the recording medium P and applies a sending force to the first surface 17 in a blowing step of S130.

In the method of introducing the recording medium to the transport path of the present example, it is possible to suppress the occurrence of the weight of the recording medium P itself causing the recording medium to escape from the transport path after introducing the recording medium P to the transport path of the recording medium P. In this manner, it is possible to improve the usability when introducing the recording medium P to the transport path.

The entire disclosure of Japanese Patent Application No. 2014-009702, filed Jan. 22, 2014 is expressly incorporated by reference herein.

What is claimed is:

1. A recording apparatus comprising:
a setting unit that sets a recording medium;
a transport unit that transports the recording medium in a transport path;
a detection unit that is provided in the transport path of the recording medium and that detects the recording medium in the transport path; and
a control unit that controls the transport unit,
wherein the transport unit includes
a drive roller that is configured to contact a first surface of the recording medium and apply a sending force to the first surface, and
a blowing unit that is provided in a position opposing the drive roller and is capable of blowing onto a second surface of the recording medium to blow the medium into contact with the drive roller, wherein the blowing unit is angled so as to blow air toward an upstream direction away from a recording head, and
wherein, when the detection unit detects the recording medium, the control unit controls the transport unit so as to cause air to be blown from the blowing unit.

2. The recording apparatus according to claim 1,
wherein the detection unit is provided on a downstream side of the transport unit in a transport direction of the recording medium.

3. The recording apparatus according to claim 1,
wherein the blowing unit is capable of adjusting an air blowing amount according to control of the control unit.

4. The recording apparatus according to claim 3, further comprising:
a transport amount detection unit capable of detecting a transport amount of the recording medium,
wherein the control unit is capable of adjusting the air blowing amount of the blowing unit according to the transport amount detected by the transport amount detection unit.

5. The recording apparatus according to claim 3,
wherein the blowing unit is capable of adjusting the air blowing amount in a direction intersecting a transport direction of the recording medium according to the control of the control unit.

6. The recording apparatus according to claim 5, further comprising:
a width detection unit capable of detecting a width of the recording medium in the direction intersecting the transport direction of the recording medium,
wherein the control unit is capable of adjusting the air blowing amount of the blowing unit in the direction intersecting the transport direction of the recording medium according to the width detected by the width detection unit.

7. The recording apparatus according to claim 5, further comprising:
a skewed transport detection unit capable of detecting a skew direction when the recording medium is subjected to skewed transport,
wherein the control unit is capable of adjusting the air blowing amount of the blowing unit in the direction intersecting the transport direction of the recording medium according to the skew direction detected by the skewed transport detection unit.

8. The recording apparatus according to claim 1, further comprising:
a recording unit which performs recording onto the recording medium,
wherein the control unit is capable of adjusting the air blowing amount of the blowing unit according to whether a recording operation to the recording medium by the recording unit is underway or not.

9. A recording apparatus comprising:
a setting unit that sets a recording medium;
a transport unit that transports the recording medium in a transport path;
a detection unit that is provided on the setting unit and detects the recording medium; and
a control unit that controls the transport unit,
wherein the transport unit includes
a drive roller that is configured to contact a first surface of the recording medium and applies a sending force to the first surface, and
a blowing unit that is provided in a position opposing the drive roller and is capable of blowing onto a second surface of the recording medium to blow the medium into contact with the drive roller, wherein the blowing unit is angled so as to blow air toward an upstream direction away from a recording head, and
wherein, when the detection unit detects the recording medium, the control unit controls the transport unit so as to cause air to be blown from the blowing unit.

10. A method of introducing a recording medium to a transport path, the method comprising:
setting the recording medium in a recording apparatus;
detecting the recording medium; and
blowing, when the recording medium is detected in the transport path, air toward a drive roller and away from a recording unit, which is provided to be capable of contacting a first surface of the recording medium and applying a sending force to the first surface, from a blowing unit which is provided in a position opposing the drive roller and is capable of blowing onto a second surface of the recording medium to blow the medium into contact with the drive roller.

* * * * *